US008599020B2

(12) United States Patent
Koike

(10) Patent No.: US 8,599,020 B2
(45) Date of Patent: Dec. 3, 2013

(54) AUTOMATED TRANSACTION APPARATUS

(75) Inventor: Hideto Koike, Gumma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 167 days.

(21) Appl. No.: 13/365,393

(22) Filed: Feb. 3, 2012

(65) Prior Publication Data

US 2013/0069784 A1 Mar. 21, 2013

(30) Foreign Application Priority Data

Sep. 15, 2011 (JP) ..... 2011-201888

(51) Int. Cl.
*G08B 13/14* (2006.01)

(52) U.S. Cl.
USPC ..... 340/568.1; 400/714

(58) Field of Classification Search
USPC ..... 340/568.1; 109/10; 200/304; 235/379; 400/714
See application file for complete search history.

(56) References Cited

U.S. PATENT DOCUMENTS

| | | | | |
|---|---|---|---|---|
| 5,419,704 | A * | 5/1995 | North | 400/714 |
| 5,748,728 | A * | 5/1998 | Ginsberg et al. | 379/447 |
| 6,552,850 | B1 * | 4/2003 | Dudasik | 109/10 |
| 7,314,161 | B1 * | 1/2008 | Korte et al. | 235/379 |
| 7,357,307 | B1 * | 4/2008 | Block et al. | 235/379 |
| D581,934 | S * | 12/2008 | Kruse et al. | D14/454 |
| 2009/0218203 | A1 * | 9/2009 | Taverner | 200/304 |
| 2012/0328350 | A1 * | 12/2012 | Taverner | 400/714 |

FOREIGN PATENT DOCUMENTS

| | | |
|---|---|---|
| JP | 2001-325665 A | 11/2001 |
| JP | 2008-287646 | 1/2008 |
| JP | 2011-76250 | 4/2011 |

* cited by examiner

*Primary Examiner* — John A Tweel, Jr.
(74) *Attorney, Agent, or Firm* — Rabin & Berdo, P.C.

(57) ABSTRACT

An embodiment of the invention provides an automated transaction apparatus including: an operation unit; a peep preventing cover that is provided in the operation unit; a sensor that detects removal of the peep preventing cover; and a control unit that performs control such that a transaction of the automated transaction apparatus is paused in accordance with a detection result of the sensor.

11 Claims, 10 Drawing Sheets

AUTOMATED TRANSACTION APPARATUS

CROSS-REFERENCE TO RELATED APPLICATIONS

This application claims priority under 35 USC 119 from Japanese Patent Application No. 2011-201888 filed on Sep. 15, 2011, the disclosure of which is incorporated by reference herein.

BACKGROUND OF THE INVENTION

1. Field of the Invention

The present invention relates to an automated transaction apparatus.

2. Description of the Related Art

Recently, automated transaction apparatus of financial institutions typified by ATMs (Automated Teller Machines) are installed in various locations such as banks, stations, and convenience stores. A customer performs various operations according to a display screen displayed on automated transaction apparatus, which allows the customer to make transactions such as a deposit, a withdrawal, and a balance inquiry.

A numerical keypad that is used to input a personal (secret) identification number and the like and a key hiding cover that hides the numerical keypad are provided in automated transaction apparatus (see Japanese Patent Application Laid-Open No. 2001-325665). The key hiding cover is provided to prevent peeping by another person during input of a personal identification number.

SUMMARY OF THE INVENTION

Recently, even if a cover that prevents peeping (hereinafter referred to as a peep preventing cover) is fixed to the automated transaction apparatus by adhesion or a screw, there is a risk that a criminal will remove or break the peep preventing cover, as a result of which a personal identification number may be stolen.

For example, when the peep preventing cover remains removed, input of a personal identification number by a customer may be watched and the personal identification number stolen.

After a peep preventing cover has been removed, it may be re-attached at the automated transaction apparatus with a hidden camera provided in the peep preventing cover, as a result of which a personal identification number may be stolen.

Therefore, the invention provides a novel and improved automated transaction apparatus that can prevent theft of a personal identification number enabled by removal of the peep preventing cover.

In accordance with an aspect of the invention, an automated transaction apparatus includes: an operation unit; a peep preventing cover that is provided in the operation unit; a sensor that detects removal of the peep preventing cover; and a control unit that performs control such that a transaction of the automated transaction apparatus is paused in accordance with a detection result of the sensor.

The control unit may perform the control such that the transaction of the automated transaction apparatus is paused if the sensor detects removal of the peep preventing cover.

The automated transaction apparatus may further include a person detection unit that detects a person present in front of the automated transaction apparatus, and the control unit may continue the transaction of the automated transaction apparatus if the person detection unit does not detect a person behind a user, even if the sensor detects removal of the peep preventing cover.

The automated transaction apparatus may further include a hand detection unit that detects a user's hand covering the operation unit, and the control unit may continue the transaction of the automated transaction apparatus if the hand detection unit detects the hand covering the operation unit, even if the sensor detects removal of the peep preventing cover.

The automated transaction apparatus may further include a display unit, and the control unit may continue the transaction of the automated transaction apparatus if an alert display is displayed on the display unit, even if the sensor detects removal of the peep preventing cover.

The control unit may resume the transaction of the automated transaction apparatus if the sensor detects that the peep preventing cover has been replaced after the transaction of the automated transaction apparatus has been paused.

The control unit may resume the transaction of the automated transaction apparatus according to a checking operation by an operator after the transaction of the automated transaction apparatus has been paused.

The automated transaction apparatus may further include an image capturing unit, and the image capturing unit may capture an image of a forward area of the automated transaction apparatus if the sensor detects removal of the peep preventing cover.

The sensor may be a micro switch, and the micro switch may be provided so as to be in contact with an attachment unit of the peep preventing cover.

The sensor may be an infrared sensor, and the infrared sensor may be provided so as to form an optical path intercepted by the peep preventing cover.

As described above, the invention can prevent theft of a personal identification number enabled by removal of the peep preventing cover.

BRIEF DESCRIPTION OF THE DRAWINGS

Preferred embodiments of the present invention will be described in detail based on the following figures, wherein.

DETAILED DESCRIPTION OF THE INVENTION

Figure 1:
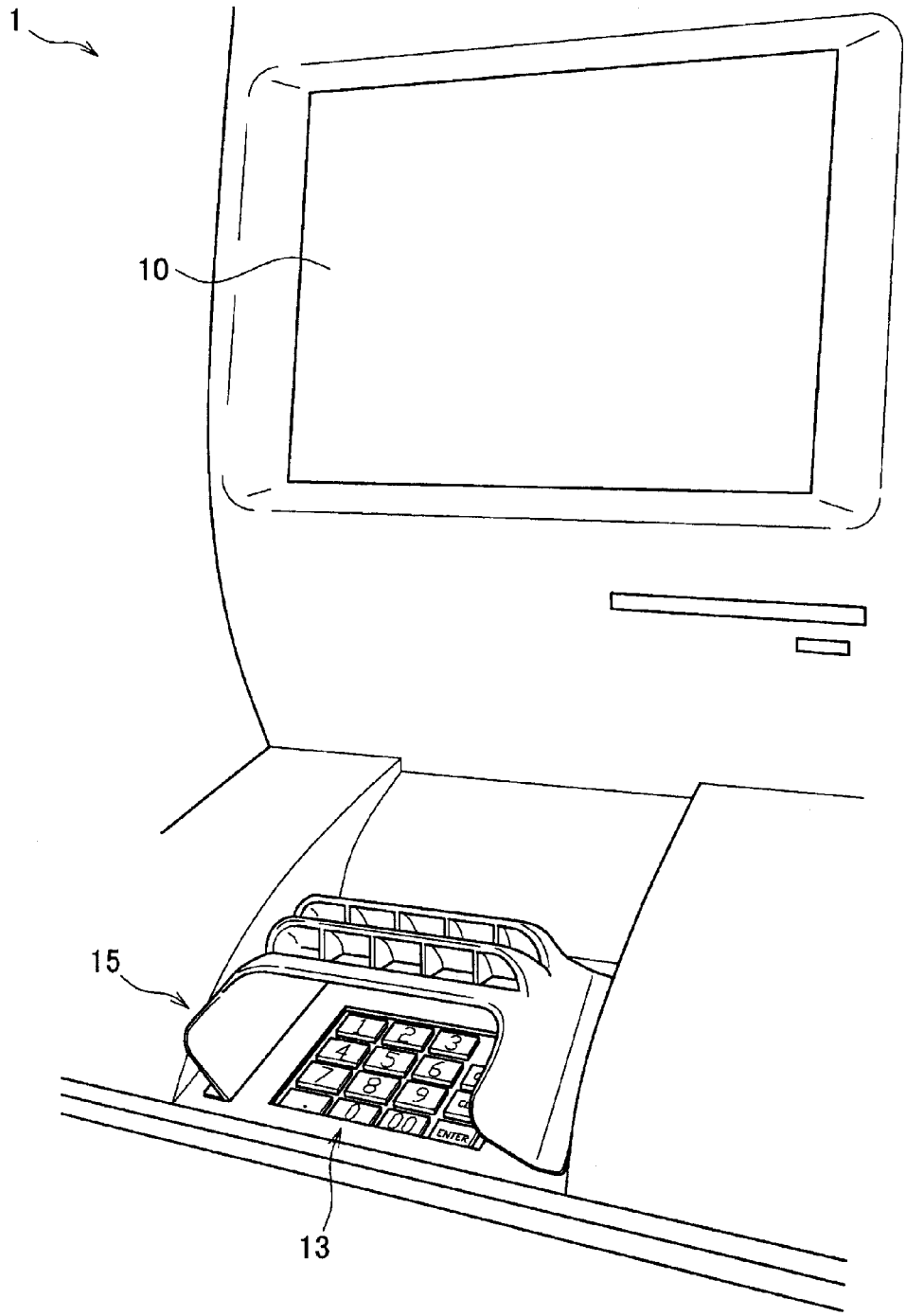
FIG. 1 is a view illustrating a configuration of a periphery of a peep preventing cover of an automated transaction apparatus according to an embodiment of the invention.

Hereinafter, an embodiment of the invention will be described in detail with reference to the drawings. In the specification and the drawings, a component substantially having an identical configuration is denoted by an identical numeral, and the overlapping description is omitted.

The invention can be implemented by the following mode described in detail in the specification. An automated transaction apparatus 1 according to an embodiment of the invention includes:

(A) an operation unit (13);

(B) a peep preventing cover (15) that is provided in the operation unit;

(C) a sensor (20) that detects removal of the peep preventing cover; and (D) a control unit (5) that performs a control such that a transaction of the automated transaction apparatus is paused in accordance with a detection result of the sensor.

A basic configuration and an operation control of the automated transaction apparatus 1 will be described after the description of an outline of the automated transaction apparatus 1.

1. Outline of Automated Transaction Apparatus

FIG. 1 is a view illustrating a configuration of a periphery of a peep preventing cover of the automated transaction apparatus 1 of the embodiment of the invention. As illustrated in FIG. 1, the automated transaction apparatus 1 includes a display unit 10, an operation unit 13, and a peep preventing cover 15.

The display unit 10 has a function of displaying a display screen in order to guide an operation performed by a customer. For example, the display function is implemented by a CRT (Cathode Ray Tube) display device, a Liquid Crystal Display (LCD) device, an OLED (Organic Light Emitting Diode) device.

The operation unit 13 has a function of detecting the customer's (the user's) operation. The operation unit 13 is constructed by a touch panel or a button, and a personal identification number or a transaction amount is input to the operation unit 13 by the customer. FIG. 1 illustrates a configuration in which the functions of the display unit 10 and the operation unit 13 are separated by way of example. However, the embodiment is not limited to the configuration of FIG. 1, and, for example, the functions of the display unit 10 and the operation unit 13 may integrally be configured.

The peep preventing cover 15 prevents a third party from peeping of the operation unit 13 from the rear side and the side of the customer to steal the personal identification number, which is input from the operation unit 13 by the customer. As illustrated in FIG. 1, a lattice-shaped opening is provided above the peep preventing cover 15 such that the customer can visually recognize the operation unit 13 and the customer's hand during the operation. FIG. 1 illustrates the peep preventing cover 15 in which the plural openings are provided thereabove by way of example. However, the embodiment is not limited to the peep preventing cover 15 of FIG. 1, and the peep preventing cover 15 in which the opening is not provided may be used, or shield plates that are provided on both sides of the operation unit 13 may be used.

(Process Leading to the Invention)

Conventionally, the automated transaction apparatus does not have the function of detecting breaking or removal of the peep preventing cover, and someone may peep to steal the personal identification number during the customer's operation when the peep preventing cover remains removed.

After removing the peep preventing cover, a criminal reattaches the peep preventing cover with a hidden camera provided in the peep preventing cover, thereby generating a crime of theft of the personal identification number with the hidden camera.

There is a risk that the personal identification number may be stolen, because the conventional automated transaction apparatus cannot detect removal of the peep preventing cover.

In view of the foregoing, the automated transaction apparatus of the embodiment of the invention is made. The automated transaction apparatus of the embodiment of the invention can prevent theft of the personal identification number, which is caused by removal of the peep preventing cover. The embodiment of the invention will be described in detail below.

2. Basic Configuration

The automated transaction apparatus 1 of the embodiment of the invention includes a sensor that detects removal of the peep preventing cover and performs the control such that the transaction pauses according to the detection result. A configuration of the automated transaction apparatus 1 will be described below with reference to FIG. 2.

Figure 2:
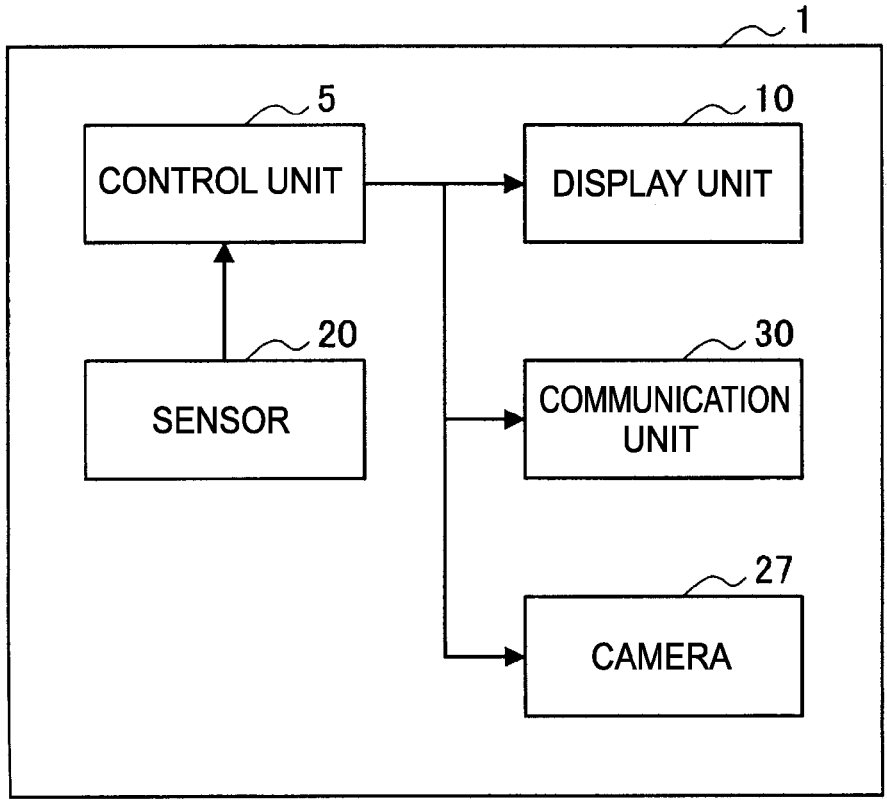
FIG. 2 is a block diagram illustrating a configuration of the automated transaction apparatus of the embodiment of the invention.

FIG. 2 is a block diagram illustrating the automated transaction apparatus 1 of the embodiment. As illustrated in FIG. 2, the automated transaction apparatus 1 includes the control unit 5, the display unit 10, the sensor 20, a communication unit 30, and a camera 27. A configuration of each unit will be described below. Because the display unit 10 is already described above, the description thereof is omitted.

The control unit 5 controls a whole operation of the automated transaction apparatus 1. For example, the control unit 5 has a function as a display control unit that controls a screen displayed on the display unit 10 and a function as a communication control unit that controls communication of the communication unit 30 with a host computer (not illustrated). The control unit 5 of the embodiment performs a pause control or a resuming control of the transaction in the automated transaction apparatus 1 according to the detection result of the sensor 20. A specific control content of the control unit 5 is described in detail in <4. Operation Control>.

The sensor 20 has a function of detecting a placement state of the peep preventing cover 15, for example, attachment and removal of the peep preventing cover 15. The sensor 20 outputs the detection result to the control unit 5. For example, the sensor 20 is constructed by a switch or an infrared sensor. A specific configuration of the sensor 20 is described in detail in <3. Removal Detection Sensor>.

The communication unit 30 which is an interface with the host computer is connected to the host computer through a dedicated line, and transmits and receives information necessary to make a transaction in the automated transaction apparatus 1. Examples of the information necessary for the transaction include customer information such as an account number, the personal identification number, and a deposit balance of the customer, and information indicating a transaction content such as a deposit amount and a withdrawal amount. When the sensor 20 has detected removal of the peep preventing cover 15, the communication unit 30 notifies the host computer that the peep preventing cover 15 is removed.

The camera 27 has an image capturing function in order to monitor the periphery of the automated transaction apparatus 1. The camera 27 of the embodiment captures an image of the periphery of the operation unit 13, a user's face or the like. When the sensor 20 has detected removal of the peep preventing cover 15, the camera 27 of the embodiment may start video recording to capture an image of a face of a person who removed the peep preventing cover 15.

The detailed configuration of the automated transaction apparatus 1 of the embodiment is described above. The specific configuration of the sensor 20 of the automated transaction apparatus 1 of the embodiment will be described below by taking plural examples.

3. Removal Detection Sensor

As described above, the sensor 20 of the embodiment has the function of detecting the placement state of the peep preventing cover 15, for example, attachment and removal of the peep preventing cover 15. For example, the sensor 20 is constructed by configurations illustrated in [3-1. Example 1] to [3-3. Example 3].

3-1. Example 1

In Example 1, a micro switch that is provided so as to be in contact with an attachment unit of the peep preventing cover 15 is cited as an example of the sensor 20. A detection method in which the micro switch of Example 1 is used will be described with reference to FIGS. 3 and 4.

Figure 3:
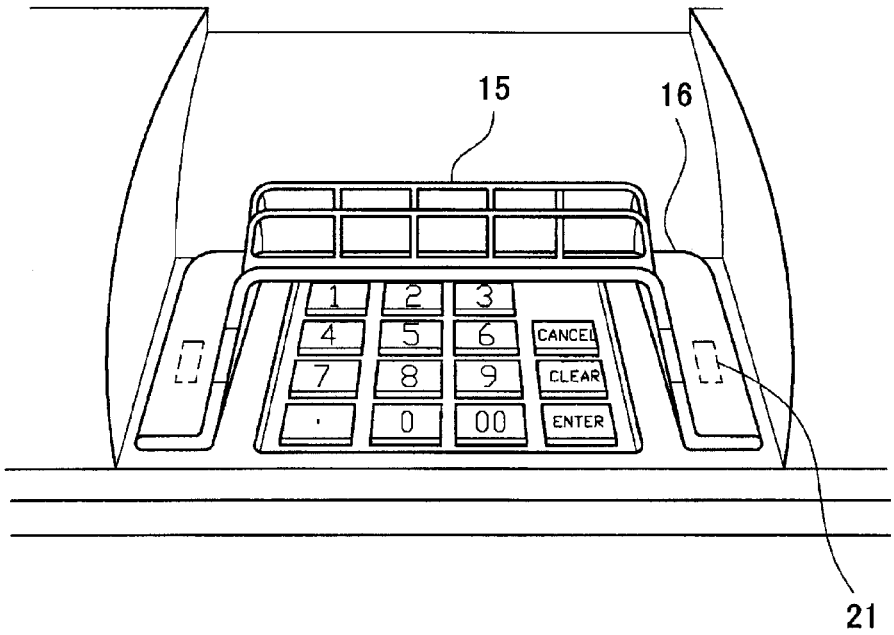
FIG. 3 is a view illustrating a positional relationship between a peep preventing cover and a micro switch according to Example 1 of the invention.

FIG. 3 is a view illustrating a state in which the peep preventing cover is placed on the micro switch of Example 1. As illustrated in FIG. 3, the peep preventing cover 15 includes an attachment unit 16. The attachment unit 16 is a member that extends along the automated transaction apparatus 1 from a side surface of the peep preventing cover 15, and the attachment unit 16 is fitted in the automated transaction apparatus 1 to attach the peep preventing cover 15 at the automated transaction apparatus 1.

As illustrated in FIG. 3, the attachment unit 16 of the example is attached above a micro switch 21 of the automated transaction apparatus 1.

Figure 4:
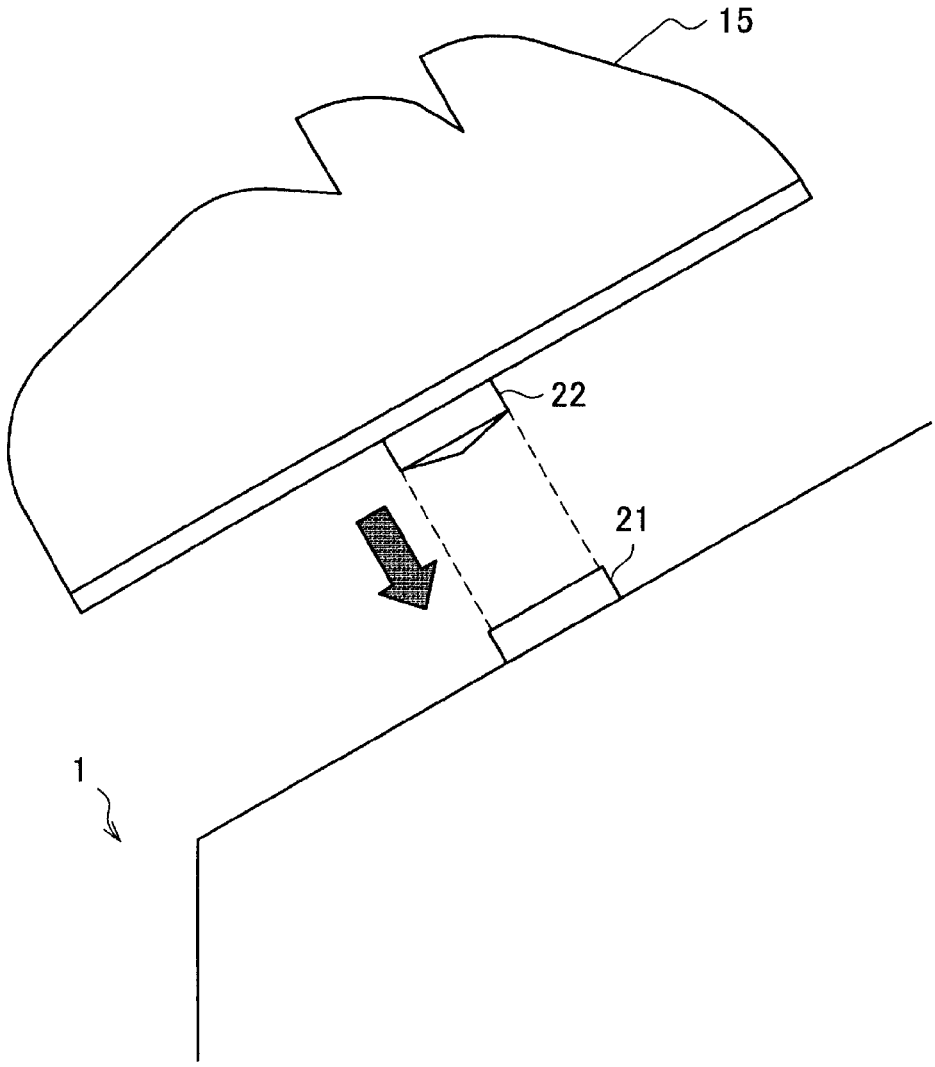
FIG. 4 is a view illustrating detection of removal of the peep preventing cover with the micro switch of Example 1 of the invention.

FIG. 4 is a view illustrating the detection of removal of the peep preventing cover 15 with the micro switch 21. As illustrated in FIG. 4, the micro switch 21 is provided in a portion in which the peep preventing cover 15 is attached at the automated transaction apparatus 1. A pawl 22 is provided at the side (the back side) at which the attachment unit 16 of the peep preventing cover 15 is attached.

As illustrated in FIG. 4, when the peep preventing cover 15 is attached at the automated transaction apparatus 1, the micro switch 21 and the pawl 22 are disposed in positions in which the pawl 22 presses the micro switch 21.

In the above configuration, when the press of the micro switch 21 by the pawl 22 has been released, the micro switch 21 outputs the detection result indicating removal of the peep preventing cover 15.

As illustrated in FIGS. 3 and 4, the micro switches 21 and the pawls 22 may be provided at the attachment unit 16 at both ends of the peep preventing cover 15, or the micro switch 21 and the pawl 22 may be provided at the attachment unit 16 at one end of the peep preventing cover 15.

3-2. Example 2

In Example 2, an infrared sensor that constitutes an optical path intercepted by the peep preventing cover 15 is cited as an example of the sensor 20. A detection method in which the infrared sensor of Example 2 is used will be described with reference to FIGS. 5 and 6.

Figure 5:
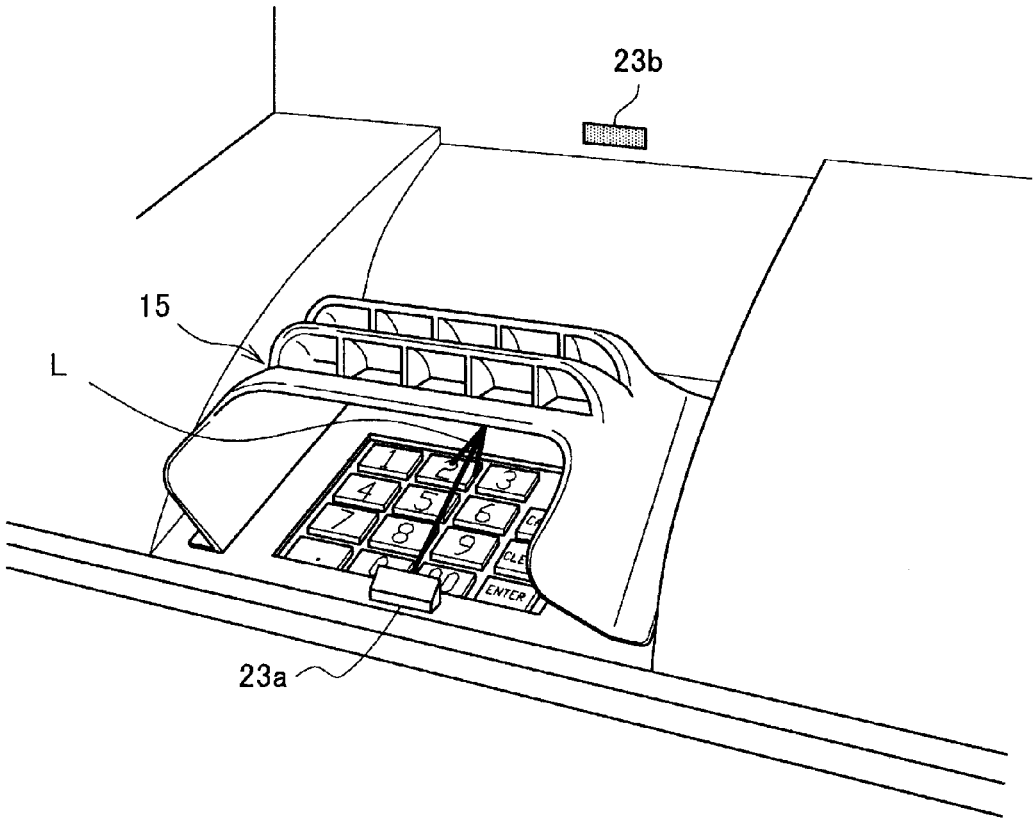
FIG. 5 is a view illustrating a state in which an optical axis of an infrared sensor according to Example 2 of the invention is intercepted by the peep preventing cover.

FIG. 5 is a view illustrating a state in which the optical axis of an infrared sensor 23 (light emitting sensor 23*a* and light receiving sensor 23*b*) of Example 2 is intercepted by the peep preventing cover 15. As illustrated in FIG. 5, the light emitting sensor 23*a* and the light receiving sensor 23*b* are placed in the automated transaction apparatus 1 so as to form an optical axis L intercepted by an upper portion of the peep preventing cover 15.

Figure 6:
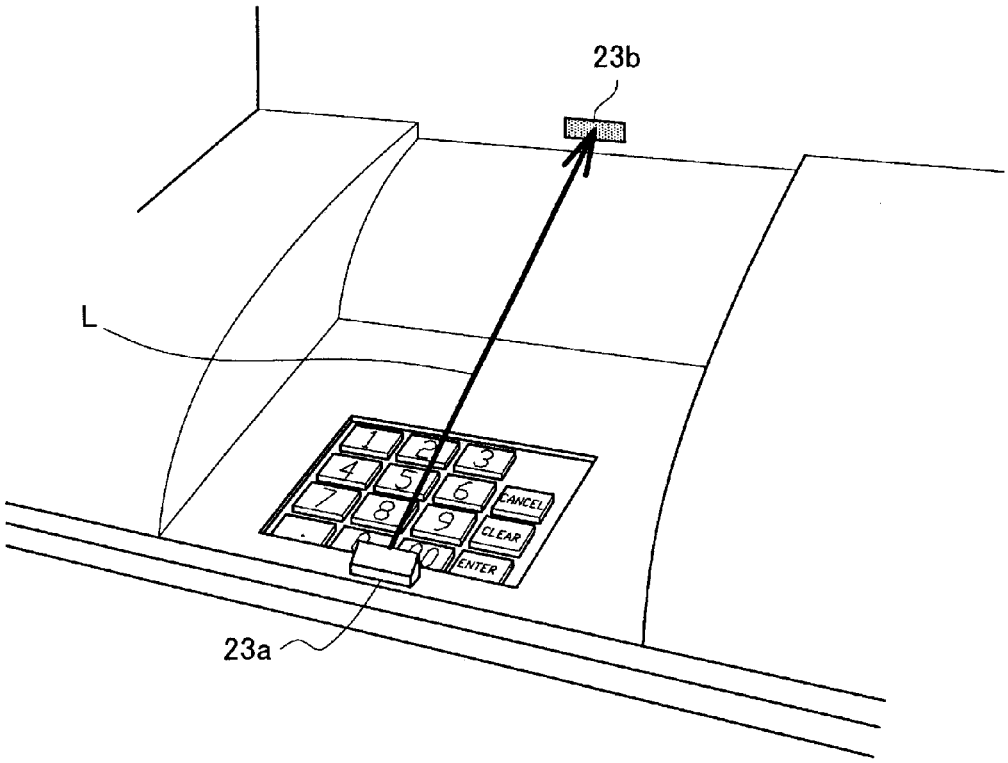
FIG. 6 is a view illustrating the detection of removal of the peep preventing cover with the infrared sensor of Example 2 of the invention.

The case in which the peep preventing cover 15 is removed will be described below with reference to FIG. 6. FIG. 6 is a view illustrating the detection of removal of the peep preventing cover 15 with the infrared sensor 23 of Example 2. As illustrated in FIG. 6, an object that intercepts the optical axis L is eliminated when the peep preventing cover 15 is removed, and a light passing state is established through the optical axis L between the light emitting sensor 23*a* and the light receiving sensor 23*b*.

When the light receiving sensor 23*b* has received light from the light emitting sensor 23*a* to establish the light passing state, the sensor of the example outputs the detection result indicating removal of the peep preventing cover 15.

(Modification)

Although the infrared sensor of Example 2 is described above, the configuration of the infrared sensor is not limited to Example 2. For example, the infrared sensor may have a configuration in which a prism is used. A modification of Example 2 will be described below with reference to FIGS. 7 and 8.

Figure 7:
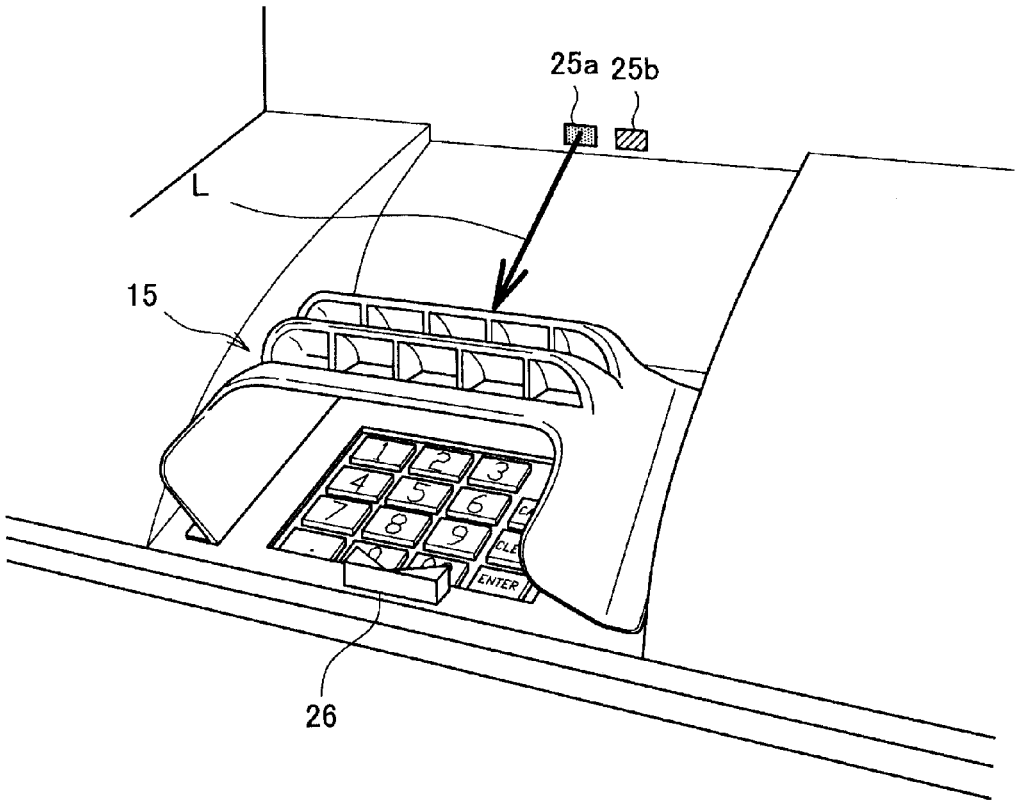
FIG. 7 is a view illustrating a state in which an optical axis of an infrared sensor according to a modification of Example 2 is intercepted by the peep preventing cover.

FIG. 7 is a view illustrating a state in which the optical axis of an infrared sensor according to a modification is intercepted by the peep preventing cover 15. As illustrated in FIG. 7, a light emitting sensor 25*a*, a light receiving sensor 25*b*, and a prism 26 are placed in the automated transaction apparatus 1 so as to form the optical axis L intercepted by the upper portion of the peep preventing cover 15. The prism 26 has a configuration in which the light is refracted by reflection. Specifically, the prism 26 refracts the light emitted from the light emitting sensor 25*a* and enters the refracted light to the light receiving sensor 25*b*.

Figure 8:
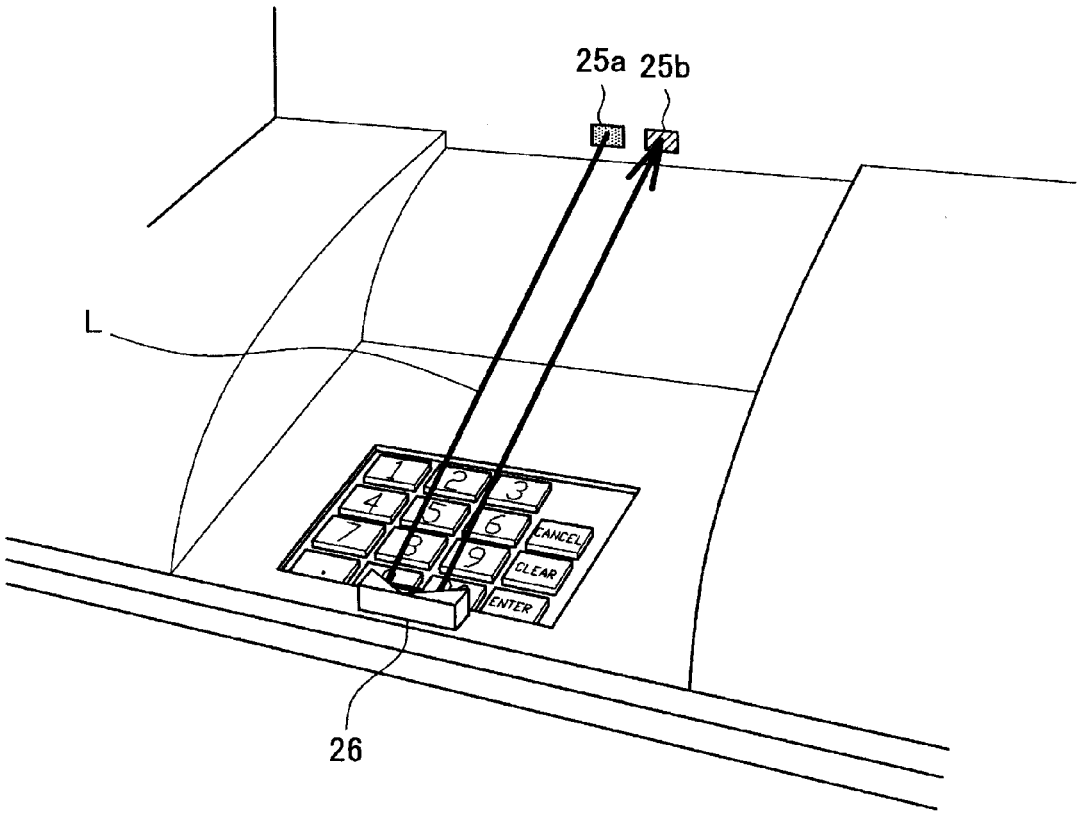
FIG. 8 is a view illustrating the detection of removal of the peep preventing cover with the infrared sensor of the modification of Example 2.

The case in which the peep preventing cover 15 is removed will be described below with reference to FIG. 8. FIG. 8 is a view illustrating the detection of removal of the peep preventing cover 15 with the infrared sensor of the modification. As illustrated in FIG. 8, the object that intercepts the optical axis L is eliminated when the peep preventing cover 15 is removed, and the light passing state is established through the optical axis L between the light emitting sensor 25*a* and the light receiving sensor 25*b*.

Thus, the light emitted from the light emitting sensor 25*a* is reflected by the prism 26 and received by the light receiving sensor 25*b*, and the light passing state is established. In this case, the sensor of the modification outputs the detection result indicating removal of the peep preventing cover 15.

3-3. Example 3

In Example 3, a camera that captures the image of the operation unit 13 and a periphery of the peep preventing cover 15 is cited as an example of the sensor 20. A detection method in which the camera of Example 3 is used will be described with reference to FIG. 9.

Figure 9:
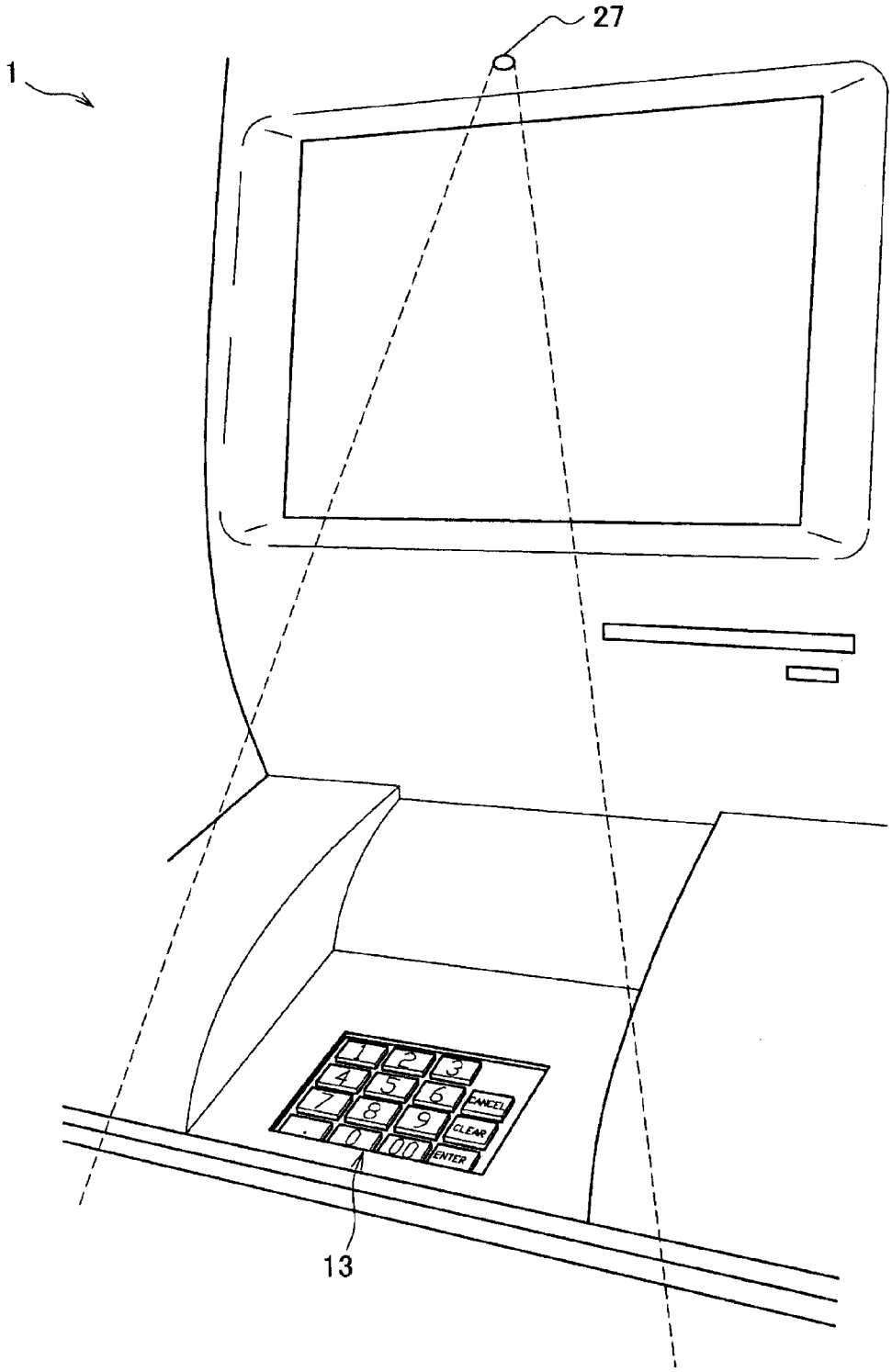
FIG. 9 is a view illustrating the detection of removal of the peep preventing cover with a camera according to Example 3 of the invention.

FIG. 9 is a view illustrating the detection of removal of the peep preventing cover 15 with the camera of Example 3. As illustrated in FIG. 9, the camera 27 placed in an upper portion of the automated transaction apparatus 1 captures the image of the periphery of the operation unit 13 of the automated transaction apparatus 1.

The camera 27 of the example includes an image capturing unit and an analysis unit that analyzes a captured image. The analysis unit analyzes the image captured by the image capturing unit, and detects removal of the peep preventing cover 15.

For example, when the peep preventing cover 15 is attached at the automated transaction apparatus 1, the peep preventing cover 15 is taken in the image captured by the camera 27, and at least part of the operation unit 13 is shielded by the peep preventing cover 15. However, when the peep preventing cover 15 is removed as illustrated in FIG. 9, the whole operation unit 13 is captured in the image by the camera 27. When the whole operation unit 13 has been extracted from the image captured by the camera 27, the camera 27 outputs the detection result indicating removal of the peep preventing cover 15.

Although the configuration of the sensor 20 is described above by raising Examples 1 to 3, the configuration of the sensor 20 of the embodiment is not limited to Examples 1 to 3. For example, the sensor 20 may be a vibration sensor that is placed in the peep preventing cover 15. In this case, the vibration sensor detects a vibration when the peep preventing cover 15 is removed, thereby detecting removal of the peep preventing cover 15.

Examples 1 to 3 of the sensors 20 may be combined. For example, the micro switch 21 of Example 1 and the infrared sensor 23 of Example 2 may be provided in the automated transaction apparatus 1. The combination enables the infrared sensor 23 to detect removal of the peep preventing cover 15, even if the micro switch 21 cannot detect removal of the peep preventing cover 15, such as, even if a tape adheres to the micro switch 21, even if the peep preventing cover is removed while the attachment unit 16 is left. Additionally, the combination enables the micro switch 21 to detect removal of the peep preventing cover 15, even if the optical axis is intercepted by the adhesion of the tape to the light emitting sensor 23*a* and the like and the infrared sensor 23 cannot detect removal of the peep preventing cover 15. Therefore, removal of the peep preventing cover 15 can more securely be detected by a combination of plural sensors.

The infrared sensor of Example 2 is provided at the front side and back side of the automated transaction apparatus 1 to form the optical axis L that horizontally divides the peep preventing cover 15. However, the disposition of the infrared sensor is not limited to Example 2. For example, the infrared sensor may be provided on the right and left of the automated transaction apparatus 1 to form the optical axis L that vertically divides the peep preventing cover 15.

4. Operation Control

The operation control of the automated transaction apparatus 1 of the embodiment will be described below. As described above, the control unit 5 of the automated transaction apparatus 1 performs the control such that the transaction in the automated transaction apparatus 1 pauses according to the detection result of the sensor 20. The pause control of the automated transaction apparatus 1 of the embodiment will be described below with reference to FIG. 10.

4-1. Pause Control

Figure 10:
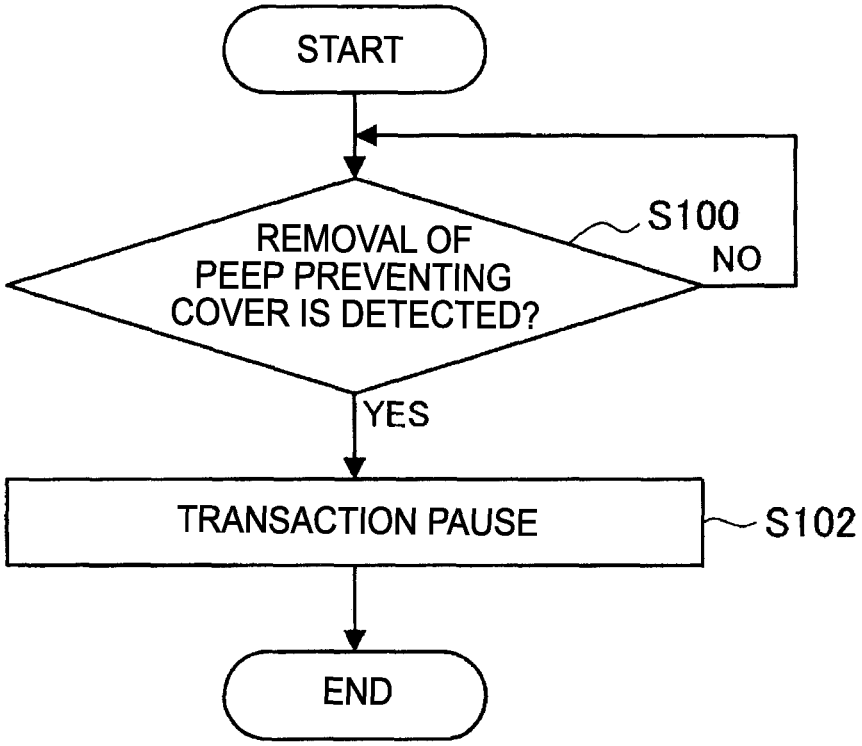
FIG. 10 is a flowchart illustrating operation control of the automated transaction apparatus of the embodiment.

FIG. 10 is a flowchart illustrating the operation control of the automated transaction apparatus 1 of the embodiment of the invention. As illustrated in FIG. 10, when the sensor 20 of the automated transaction apparatus 1 has detected removal of the peep preventing cover 15 in Step S100, the control unit 5 performs the control such that the transaction in the automated transaction apparatus 1 pauses in Step S102. As used herein, the pause control of the transaction means a control to stop some of or all of the transactions which the automated transaction apparatus 1 can perform. For example, the transaction in which inputting the personal identification number is not necessary may be continued.

Therefore, theft of the personal identification number can securely be prevented beforehand when the customer operates the automated transaction apparatus 1 while the peep preventing cover 15 remains removed, or theft of the personal identification number, which is caused by re-attaching the peep preventing cover 15, which has been removed once, at the automated transaction apparatus 1 with a monitoring camera placed in the peep preventing cover 15, can securely be prevented beforehand.

The control unit 5 may perform the control so as to continue the transaction in the automated transaction apparatus 1 in the case in which a predetermined condition is satisfied even if the peep preventing cover 15 is removed. Plural examples can be raised as the case in which the predetermined condition is satisfied.

(First Control Example)

The control unit 5 performs the control so as to continue the transaction in the automated transaction apparatus 1 when a person has not been detected behind the customer even if the sensor 20 has detected removal of the peep preventing cover 15.

A person detection unit that detects a person may be a camera which includes an image capturing unit that captures an image in front of the automated transaction apparatus 1 and an analysis unit that analyzes the captured image, or a proximity sensor that detects the person present in front of the automated transaction apparatus 1.

Even if the peep preventing cover 15 is removed, if the person does not present behind the customer (the user), since there is no risk that the personal identification number may be stolen, the control unit 5 continues the transaction.

(Second Control Example)

The control unit 5 performs the control so as to continue the transaction in the automated transaction apparatus 1 when the customer covers the operation unit 13 by the hand or the like of customer even if the sensor 20 detects removal of the peep preventing cover 15.

A hand detection unit that detects the hand or the like which covers the operation unit 13 may be the camera, the proximity sensor, an illuminance sensor or the like.

Even if the peep preventing cover 15 has been removed, when the customer (user) performs the operation while covering the operation unit 13, since there is no risk that the personal identification number may be stolen, the control unit 5 continues the transaction.

(Third Control Example)

The control unit 5 performs the control so as to continue the transaction in the automated transaction apparatus 1 when an alert display has been displayed on a display unit 10 even if the sensor 20 has detected removal of the peep preventing cover 15.

Even if the peep preventing cover 15 has been removed, the customer (user) performs the operation while paying attention to the peeping according to the alert display on the display unit 11, since a possibility of theft of the personal identification number is decreased, the control unit 5 continues the transaction.

The pause control performed by the control unit 5 of the embodiment is described above. The control unit 5 of the embodiment may also perform the following control while performing the pause control, when the sensor 20 has detected removal of the peep preventing cover 15.

(Warning Sound)

For example, the control unit 5 may perform control so as to output a loud warning sound from a speaker (not illustrated). Therefore, removing the peep preventing cover 15 by a criminal can be stopped.

(Video Recording)

The control unit 5 controls the camera which captures the image of the front of the automated transaction apparatus 1, and the control unit 5 may perform video recording of the face of the criminal who is removing the peep preventing cover 15 when removal of the peep preventing cover 15 has been detected. Recorded image data of the criminal's face can be used in police criminal investigation. At this point, the camera that captures the image in front of the automated transaction apparatus 1 may be the camera 27 of FIG. 9, for example. In this case, the camera 27 of FIG. 9 is placed in the upper portion of the automated transaction apparatus 1 to captures the image of the periphery of the operation unit 13, and the control unit 5 can widen and change an image capturing range of the camera 27 to perform image capturing and/or video recording of the face of the criminal who removes the peep preventing cover 15.

The camera that captures the image of the criminal's face may be placed in a position in which the camera is hidden behind the peep preventing cover 15 in addition to the position in which the camera 27 is placed as illustrated in FIG. 9. In this case, the camera can capture the image of the criminal's face when the peep preventing cover 15 has been removed.

4-2. Resuming Control

Transaction resuming (returning) control, which is performed by the control unit 5, in the automated transaction apparatus 1 after the pause will be described below.

For example, there is a probability that the hidden camera is attached at the peep preventing cover 15 removed once. Therefore, the control unit 5 may resume the transaction of the automated transaction apparatus 1 according to a checking operation of an operator (a service staff). In association with the pause control, the control unit 5 previously notifies the host computer through the communication unit 30 that removal of the peep preventing cover 15 is detected.

In response to the notification, the operator goes to the site to check the corresponding automated transaction apparatus 1. When the resuming has been instructed because an abnormality has not been found by the operator, the control unit 5 performs the control so as to resume the transaction of the automated transaction apparatus 1.

In addition to the above resuming control, the control unit 5 may perform the resuming control when the sensor has detected that the peep preventing cover 15 has been replaced after the pause. This is because there is a small risk that the third party peeps to steal the personal identification number during the operation of the customer when the peep preventing cover 15 has been replaced.

5. Summary

As described above, according to the automated transaction apparatus 1 of the embodiment, the control unit 5 performs the control such that the transaction in the automated transaction apparatus 1 is paused when removal of the peep preventing cover 15 is detected. Therefore, the theft of a personal identification number can securely be prevented in advance when a customer operates the automated transaction apparatus 1 while the peep preventing cover 15 remains removed. Further, the theft of a personal identification number, which is caused by reattaching the peep preventing cover 15, which has been removed once, at the automated transaction apparatus 1 with a monitoring camera placed in the peep preventing cover 15, can securely be prevented in advance.

Although the preferred embodiment of the invention is described in detail above with reference to the accompanying drawings, the invention is not limited to the embodiment. It will be clear that those skilled in the art may easily make various modifications and changes without departing from the technical concepts of the claims, and it is understood that the modifications and changes are also included in the technical scope of the invention.

For example, a sensor that detects that a camera is attached inside the peep preventing cover 15 may be provided in consideration of the possibility that a hidden camera is attached inside the peep preventing cover 15 in order to steal a personal identification number without removing the peep preventing cover 15. More specifically, for example, the infrared sensor through the right and left (horizontally) of the peep preventing cover 15 is provided at the peep preventing cover 15 side or the main body side of the automated transaction apparatus 1. Therefore, the control unit 5 performs the pause control of the transaction of the automated transaction apparatus 1 or the warning control when it has been detected that a camera is attached inside the peep preventing cover 15.

The processing of each functional block of the automated transaction apparatus 1, which is illustrated in the block diagram of FIG. 2, can be implemented by hardware such as a CPU (Central Processing Unit), a ROM (Read Only Memory), and a RAM (Random Access Memory). A computer program that causes the hardware to exert the same function as each functional block of the automated transaction apparatus 1 can also be produced. A storage medium in which the computer program is stored is also provided. Examples of the recording medium include a magnetic disk, an optical disk, a magneto-optical disk, and a flash memory. The computer program may be distributed without using the recording medium, through a network.

Embodiments of the present invention are described above, but the present invention is not limited to the embodiments as will be clear to those skilled in the art.

What is claimed is:

1. An automated transaction apparatus comprising:

an operation unit;

a peep preventing cover that is provided in the operation unit;

a sensor that detects removal of the peep preventing cover; and a control unit that performs control such that a transaction of the automated transaction apparatus is paused in accordance with a detection result of the sensor.

2. The automated transaction apparatus according to claim 1, wherein the control unit performs the control such that the transaction of the automated transaction apparatus is paused if the sensor detects removal of the peep preventing cover.

3. The automated transaction apparatus according to claim 1, further comprising a person detection unit that detects a person present in front of the automated transaction apparatus, wherein the control unit continues the transaction of the automated transaction apparatus if the person detection unit does not detect a person behind a user, even if the sensor detects removal of the peep preventing cover.

4. The automated transaction apparatus according to claim 1, further comprising a hand detection unit that detects a user's hand covering the operation unit, wherein the control unit continues the transaction of the automated transaction apparatus if the hand detection unit detect the user's hand covering the operation unit, even if the sensor detects removal of the peep preventing cover.

5. The automated transaction apparatus according to claim 1, further comprising a display unit, wherein the control unit continues the transaction of the automated transaction apparatus if an alert display is displayed on the display unit, even if the sensor detects removal of the peep preventing cover.

6. The automated transaction apparatus according to claim 1, wherein the control unit resumes the transaction of the automated transaction apparatus if the sensor detects that the peep preventing cover has been replaced after the transaction of the automated transaction apparatus has been paused.

7. The automated transaction apparatus according to claim 1, wherein the control unit resumes the transaction of the automated transaction apparatus in accordance with a checking operation by an operator after the transaction of the automated transaction apparatus has been paused.

8. The automated transaction apparatus according to claim 1, further comprising an image capturing unit, wherein the image capturing unit captures an image of a forward area of the automated transaction apparatus if the sensor detects removal of the peep preventing cover.

9. The automated transaction apparatus according to claim 1, wherein the sensor is a micro switch, and the micro switch is provided so as to be in contact with an attachment unit of the peep preventing cover.

10. The automated transaction apparatus according to claim 1, wherein the sensor is an infrared sensor, and the infrared sensor is provided so as to form an optical path intercepted by the peep preventing cover.

11. The automated transaction apparatus according to claim 1, wherein the sensor includes a micro switch and an infrared sensor, the micro switch is provided so as to be in contact with an attachment unit of the peep preventing cover, and the infrared sensor is provided so as to form an optical path intercepted by the peep preventing cover.

* * * * *